United States Patent [19]

Pistor et al.

[11] Patent Number: 4,493,429

[45] Date of Patent: Jan. 15, 1985

[54] ARRANGEMENT FOR OPENING AND CLOSING A COVER OF A TRANSPORT AND TREATMENT CONTAINER

[75] Inventors: Dieter Pistor; Ludwig Mankut, both of Altdorf, Fed. Rep. of Germany

[73] Assignee: Schering Aktiengesellschaft, Berlin and Bergkamen, Fed. Rep. of Germany

[21] Appl. No.: 451,548

[22] Filed: Dec. 21, 1982

[30] Foreign Application Priority Data

Dec. 22, 1981 [DE] Fed. Rep. of Germany ..... 3151244

[51] Int. Cl.[3] ..... B65D 55/00

[52] U.S. Cl. ..... 220/211; 220/260; 220/245

[58] Field of Search ..... 220/260, 211, 200, 238, 220/243, 244, 245, 251

[56] References Cited

U.S. PATENT DOCUMENTS

| | | | |
|---|---|---|---|
| 1,083,305 | 1/1914 | Sweetland | 220/211 |
| 3,195,761 | 7/1965 | Coats | 220/211 |
| 3,385,655 | 5/1968 | Huston et al. | 220/211 |
| 3,623,627 | 11/1971 | Bolton | 220/211 |
| 4,119,238 | 10/1978 | Ali Ja'afar et al. | 220/211 |

*Primary Examiner*—Joseph Man-Fu Moy
*Attorney, Agent, or Firm*—Michael J. Striker

[57] ABSTRACT

An arrangement for opening and closing a cover of a transport- and treatment container has a toggle closure movable between open and closed positions in which it removes a cover from a container and applies the cover on the container, respectively, and a gripping device arranged to move the toggle closure between the open and closed positions and provided with two cams located at opposite sides of the toggle closure and engageable with the latter.

22 Claims, 3 Drawing Figures

ARRANGEMENT FOR OPENING AND CLOSING A COVER OF A TRANSPORT AND TREATMENT CONTAINER

BACKGROUND OF THE INVENTION

The present invention relates to an arrangement for opening and closing a cover of a transport- and treatment container. More particularly, it relates to an arrangement for automatically opening and closing a cover of a transport- and treatment drum, particularly for shakeable bulk materials.

Surface treatment in wet mediums, such as for example galvanization, of shakeable bulk materials is performed predominantly in drums. The drums rotate during the treatment process about their longitudinal axes, and the material to be treated rolls inside the drum so that the individual portions of the material continuously change their position. This is necessary to provide uniform treatment of all surface sections of the individual portions of the material. It has been recognized as advantageous to rotate the drum continuously in one direction. It is necessary to form the drum as a closable body, so that the portions of the material do not drop outwardly during the rotation. For filling and emptying of the drum, openings must, however, be provided. These openings are closed after the filling step with covers which must be removed for emptying the treated material. Several solutions have been proposed in practice for the cover and its closure, in other words mounting on the drum body. It is, however, necessary in general to carry out opening and closing of the closure, as well as removal and application of the cover by hand. For this function, not only expensive personnel is required, but also the manual operation contradicts automation of the process.

SUMMARY OF THE INVENTION

Accordingly, it is an object of the present invention to provide an arrangement for opening and closing of a cover of a transport- and treatment container, which avoids the disadvantages of the prior art.

More particularly, it is an object of the present invention to provide an arrangement for opening and closing of a cover of a transport- and treatment drum, which operates automatically and does not require performance of respective operations by hand.

In keeping with these objects and with others which will become apparent hereinafter, one feature of the present invention resides, briefly stated, in an arrangement for opening and closing a cover of a transport- and treatment container, which has a toggle closure movable between open and closed positions in which it removes a cover from a container and applies the cover on the container, respectively, wherein gripping means is provided to move the toggle closure between the open and closed positions, the gripping means having two cams located at opposite sides of the toggle closure and engageable with the latter.

When the arrangement is designed in accordance with the present invention, it is no longer necessary to move the toggle closure by hand. The gripping means provide automatic movement of the toggle closure between its open and closed positions so as to remove the cover from the container or to apply the cover on the container to close the latter.

In accordance with another feature of the present invention, the toggle closure has grooves in which the cams of the gripping means can engage.

Yet another feature of the present invention is that the toggle closure is provided with two grooves which are arranged opposite to one another.

In accordance with a further feature of the present invention, the grooves of the toggle closure and the cams of the gripping means are formed mirror-inverted relative to one another.

Still a further feature of the present invention is that the drum cover is provided with stops for the toggle member, so that the turning movement of the toggle member is limited by the stops.

The drum cover may have a peripheral portion which is provided with inclined guiding surfaces.

Yet a further feature of the present invention is that the toggle member is provided with inclined guiding surfaces which cooperate with the gripping means.

The gripping means may include a bell-shaped part on which the above mentioned cams are arranged.

The gripping means may be arranged so that it is turnable, or it is vertically and horizontally movable.

The gripping means can be provided with a circumferentially uninterrupted or segment-like guiding edge.

Still another feature of the present invention is that means may be provided for adjusting the position of the gripping means and the toggle closure relative to one another.

An additional feature of the present invention is that a drive and operating elements are provided for actuating the gripping means, whereas the drive may include pneumatically, hydraulically or electric-motor operated devices.

The drive for the vertical and horizontal movement of the gripping means may be controllable independently of one another.

Yet an additional feature of the present invention is that the drum cover can be provided with two toggle closures and two gripping means cooperating with the toggle closures for movement of the latter to the open and closed positions. The toggle closures can move during the operation in opposite directions.

All drives for actuation of the arrangement may be provided with means for damping the operation steps.

Finally, the arrangement can be formed as a part of an automatic surface treatment device.

As mentioned above, the inventive arrangement makes possible in an advantageous manner performance of automatic opening and closing of the cover for transport- and treatment drums. It is especially advantageous that this arrangement is suitable for opening and closing of covers provided with conventional closures which are accepted in practice and have been operated only by hand. The inventive arrangement is suitable for use in automatic surface treatment devices with goods stations, transport devices and storage locations.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
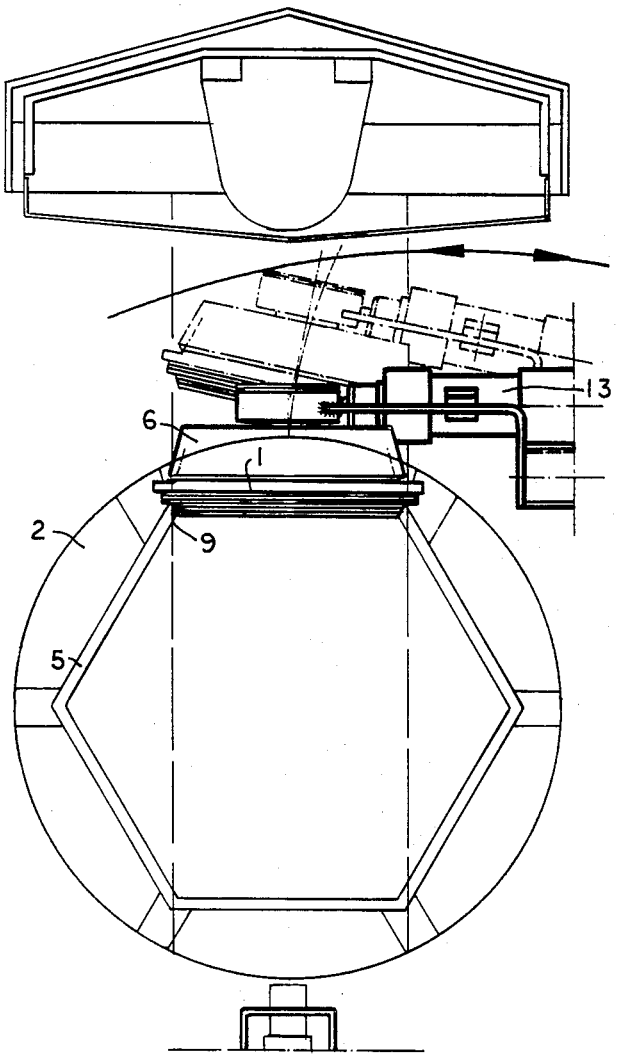
FIG. 1 is a view showing a section of an arrangement for opening and closing a cover of a container, in accordance with the present invention.

An arrangement for opening and closing in accordance with the present invention is shown as associated with a cover 1 and a drum 2. The drum 2 has a drum body which is identified by reference numeral 5.

The drum 2 is closed by the cover 1 with the aid of a toggle closure 3 which engages in grooves of a drum body 5 and thereby fixes the cover on the latter. Two such toggle closures are provided for closing the drum shown in the drawing.

Figure 3:
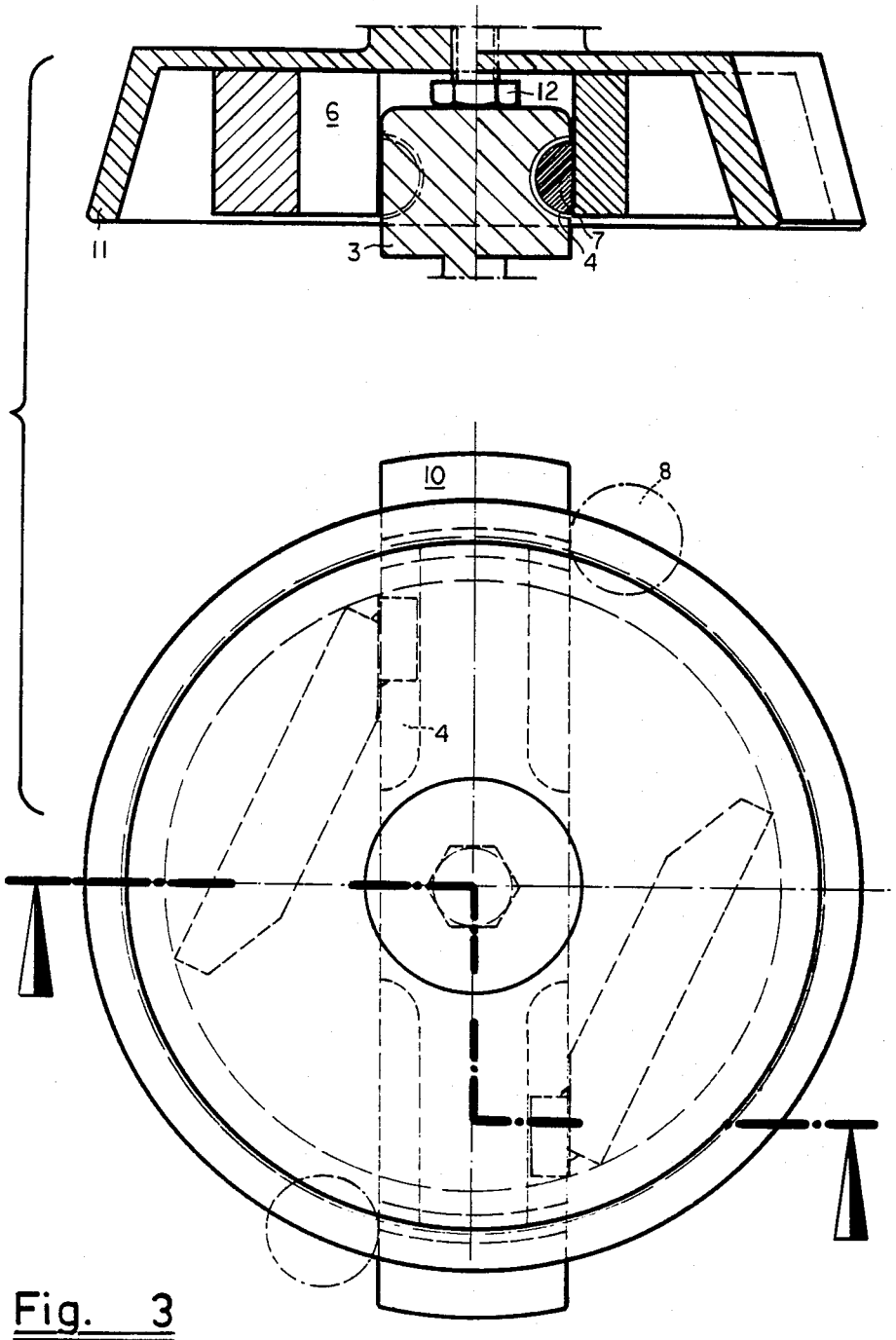
FIG. 3 are a section and a plan view of a fragment of the inventive arrangement.

In accordance with the invention, gripping means is provided for moving the toggle closures 3 between open and closed positions. The gripping means includes two gripping elements identified with reference numeral 6. The gripping elements 6 are bell-shaped, as can be seen from FIG. 3*a*. Each gripping element 6 has two oppositely located cams 7. On the other hand, each toggle closure 3 has at least two grooves arranged so that the cams 7 can engage in these grooves. As can be seen from FIG. 3*b*, there are two pairs of grooves located at opposite sides of each toggle closure. The grooves 4 of the toggle closures 3 and the cams 7 of the gripping elements 6 are formed mirror-inverted relative to one another.

The toggle closures 3 are turnable. The drum cover 1 is provided with stops 8 which are arranged for limiting the turning movement of the toggle closures 3. The cover 1 has a peripheral portion with inclined guiding surfaces 9.

The toggle closures 3 have inclined guiding surfaces for the gripping elements 6. These guiding surfaces are identified with reference numeral 10. Each gripping element has, in turn, a guiding edge 11. The gripping elements 6 are arranged turnable about their axes. At the same time, they are movable vertically and horizontally. The guide edge of each gripping member 6 can be circumferentially closed or segment-shaped.

The position of the gripping elements 6 and the toggle closures 3 relative to one another can be adjusted, for example with the aid of an adjusting member 12.

The gripping elements 6 are provided with a drive 13 and actuating members 14. The drive 13 may include pneumatically, hydraulically or electro-motor operated devices. The drives 13 for the vertical and horizontal movement of the gripping elements 6 may be controllable independently on one another.

Figure 2:
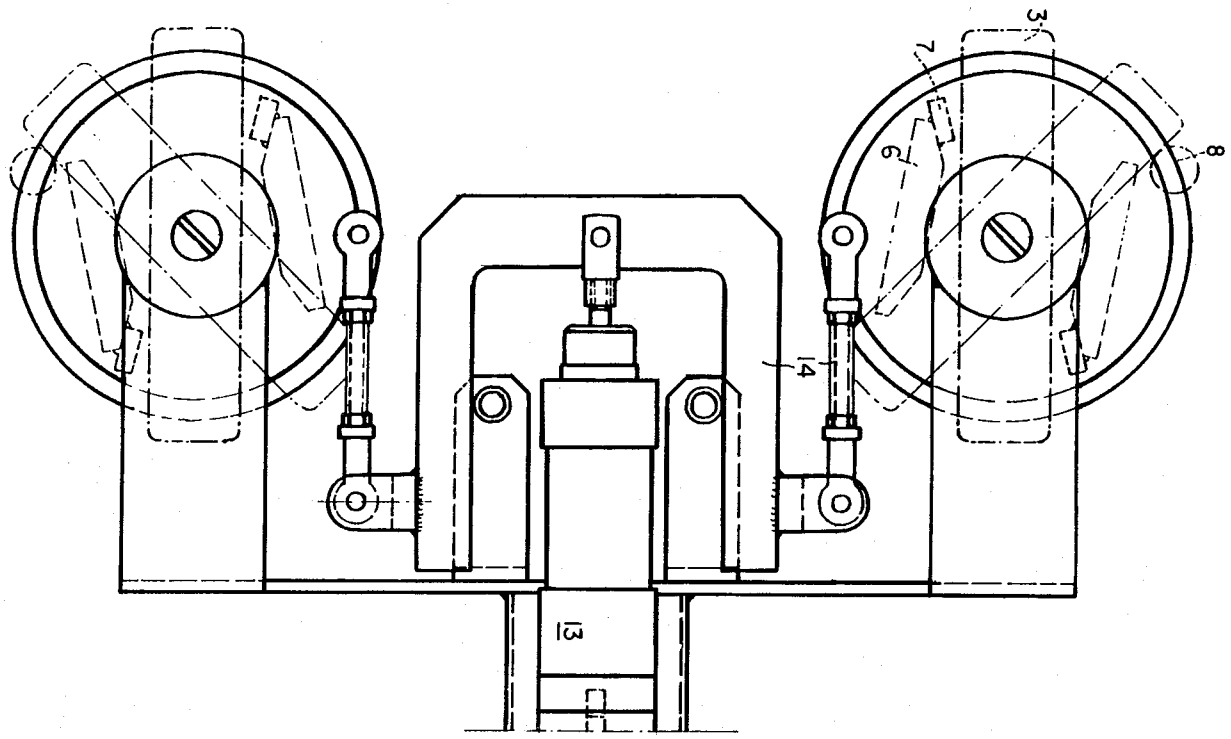
FIG. 2 is a plan view of the inventive arrangement of FIG. 1.

As can be seen from FIG. 2, the toggle closures 3 and the gripping elements 6 are arranged so that during closing and opening of the container the toggle closures 3 move in opposite directions. All drives for operation of the arrangement can be provided with means for damping the movement steps. Finally, the arrangement can be a part of an automatic surface treatment device.

The arrangement operates in the following manner:

For opening the cover, the drum body 5 must be moved in its direction of rotation and then in its axial direction to assume a suitable position. Then, the gripping element 6 is turned toward the toggle closure and lowered. The gripping element 6 is rotated, engages the toggle closure 3, brings it to the open position and locks the cover 1 from dropping out. After this, the gripping element 6 is lifted together with the cover, and turned back so as to turn the cover away from the drum body 5.

Closing of the cover is performed in a reverse order. The gripping element 6 is turned together with the cover toward the drum body and lowered. Then the gripping element is rotated and brings thereby the toggle closure 3 to its closed position. After this, the gripping element is brought to its neutral position, or in other words is rotated back. Then it is lifted without the cover and turned back away from the drum body.

It will be understood that each of the elements described above, or two or more together, may also find a useful application in other types of constructions differing from the types described above.

While the invention has been illustrated and described as embodied in an arrangement for opening and closing a cover of a transport- and treatment container, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An automatic arrangement for opening and closing a cover of a transport- and treatment container, comprising:

at least one toggle closure carrying the cover and engageable in said container to fix the cover on the latter, said toggle closure being movable between an open position in which it removes the cover from the container and a closed position in which it applies the cover onto the container; and at least one gripping means having an axis and being turnable about its axis and arranged to move said toggle closure between said open and closed position, said gripping means being engageable with said toggle closure, said gripping means having two cams, and said toggle closure having cam-receiving means arranged so that said cams are positioned at opposite sides of said toggle closure and engaged in said cam-receiving means when said gripping means are turned to be engaged with said toggle closure.

2. An arrangement as defined in claim 1, wherein said cam-receiving means are grooves arranged so that said cams of said gripping means engage in said grooves.

3. An arrangement as defined in claim 2, wherein said toggle closure has at least two grooves arranged opposite to one another.

4. An arrangement as defined in claim 3, said grooves of said toggle closure and said cams of said gripping means being formed mirror-inverted.

5. An arrangement as defined in claim 1, wherein said toggle closure is turnable; and further comprising stops arranged on the cover and limiting the turning of said toggle closure.

6. An arrangement as defined in claim 1, the cover having a peripheral portion with inclined guiding surfaces.

7. An arrangement as defined in claim 1, wherein said toggle closure has inclined guiding surfaces cooperating with said gripping means.

8. An arrangement as defined in claim 1, wherein said gripping means is formed as a bell-shaped element provided with said cams.

9. The arrangement as defined in claim 1, wherein said container is rotatable to assume a suitable position of said cover relative to said gripping means.

10. An arrangement as defined in claim 1, wherein said gripping means is arranged vertically and horizontally movable.

11. An arrangement as defined in claim 1, wherein said gripping means has a circumferential guiding edge.

12. An arrangement as defined in claim 1, wherein said gripping means has a segment-like guiding edge.

13. An arrangement as defined in claim 1; and further comprising means for adjusting the position of said gripping means and said toggle closure relative to one another.

14. An arrangement as defined in claim 1, and further comprising drive means, and actuating elements connected with said drive means and said gripping means to turn the latter.

15. An arrangement as defined in claim 14, wherein said drive means for said gripping means is formed as pneumatically operated drive means.

16. An arrangement as defined in claim 14, wherein said drive means for said gripping means is formed as hydraulically operated drive means.

17. An arrangement as defined in claim 14, wherein said drive means for said gripping means is formed as electric-motor-operated drive means.

18. An arrangement as defined in claim 1, wherein said gripping means is movable in horizontal and vertical directions; and further comprising drive means for moving said gripping means in horizontal and vertical directions controllable independently on one another.

19. An arrangement as defined in claim 1; and further comprising a second such toggle closure for the same cover, and a second such gripping means arranged to move said second toggle closure between second such open and closed positions.

20. An arrangement as defined in claim 19, wherein said first-mentioned and second toggle closures are turnable in opposite directions.

21. An arrangement as defined in claim 1; and further comprising means for damping the movement of said toggle closure.

22. An arrangement as defined in claim 1, wherein said toggle closure and said gripping means are parts of an automatic surface treatment device.

* * * * *